US007515870B2

(12) United States Patent
Ikusawa

(10) Patent No.: US 7,515,870 B2
(45) Date of Patent: Apr. 7, 2009

(54) IMAGE FORMING DEVICE, IMAGE FORMING METHOD, AND COMPUTER READABLE RECORDING MEDIUM STORED WITH IMAGE FORMING PROGRAM

(75) Inventor: Takeshi Ikusawa, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 216 days.

(21) Appl. No.: 11/193,345

(22) Filed: Aug. 1, 2005

(65) Prior Publication Data

US 2006/0193667 A1 Aug. 31, 2006

(30) Foreign Application Priority Data

Feb. 28, 2005 (JP) ..... 2005-054711

(51) Int. Cl.
*G03G 15/00* (2006.01)

(52) U.S. Cl. ..... 399/405; 399/407

(58) Field of Classification Search ..... 271/193, 271/275, 145–171; 347/104; 400/624–629
See application file for complete search history.

(56) References Cited

U.S. PATENT DOCUMENTS 5,289,250 A 2/1994 Hiroi et al.

FOREIGN PATENT DOCUMENTS

| | | |
|---|---|---|
| JP | 5-8581 | 1/1993 |
| JP | 11-049415 A | 2/1999 |
| JP | 2000-255882 | 9/2000 |
| JP | 2001-301-245 | 10/2001 |
| JP | 2003-341916 A | 12/2003 |
| JP | 2004-243581 A | 9/2004 |

OTHER PUBLICATIONS

Official Action (Notification of Reason for Refusal) issued by the Japanese Patent Office in priority JP Patent Application No. 2005-054711 on Oct. 10, 2006; and English translation thereof.

A Notification of Reason for Refusal issued in corresponding Japanese Patent Application No. 2005-054711, and translation thereof.

*Primary Examiner*—Daniel J Colilla
*Assistant Examiner*—Allister Primo
(74) *Attorney, Agent, or Firm*—Buchanan Ingersoll & Rooney PC

(57) ABSTRACT

The image forming device compares the size of the paper ready to be discharged with the size of the paper left on the paper tray if there is any paper left on the paper tray, and supplies a supporting member having a larger bending strength than the paper onto the paper left on the paper tray depending on the result of the comparison.

17 Claims, 7 Drawing Sheets

IMAGE FORMING DEVICE, IMAGE FORMING METHOD, AND COMPUTER READABLE RECORDING MEDIUM STORED WITH IMAGE FORMING PROGRAM

This application is based on Japanese Patent Application No. 2005-054711 filed on Feb. 28, 2005, the contents of which are hereby incorporated by reference.

BACKGROUND OF THE INVENTION

1. Field of the Invention

The invention relates to an image forming device, an image forming method, and a computer readable recording medium stored with an image forming program. The invention relates to an image forming device, in particular, such a device capable of supporting paper to be discharged to a paper tray by carrying it on said paper tray, an image forming method, and a computer readable recording medium stored with an image forming program.

2. Description of the Related Art

A large amount of printed paper is discharged onto a paper tray in an image forming device capable of a large amount of printing.

When paper of a larger size is discharged after a large amount of paper of a smaller size is discharged in such an image forming device, a portion of the larger size paper that sticks out from the surface of the paper of the smaller tends to bend downward due to gravity. If the paper bent as such is left for a while on the paper tray, the paper may create a permanent deformation or a crease.

Therefore, the user is forced to do a cumbersome work of constantly watching the paper tray of the image forming device and removing paper left on the paper tray in order to prevent the formation of permanent bends or creases when paper of a plurality of sizes is to be discharged on the paper tray in large quantities.

As a technology of preventing the bend of paper discharged on the paper tray, an image forming device capable of controlling a mechanical stopper that dictates the positioning of sheets being discharged on the paper tray is disclosed (see Unexamined Publication No. JP-A-2000-255882). However, this image forming device intends to prevent the bending of sheets of paper by stopping the motion of the mechanical stopper when it detects the sheets of paper while moving the mechanical stopper in the direction opposite to the direction of paper discharge. Consequently, this image forming device only prevents the bending of sheets of paper caused by abutting of the mechanical stopper against the sheets of paper so that it is incapable of preventing the bending of larger size paper discharged on top of smaller size paper.

Also, a sheet post-processing device has been disclosed for straitening sheets of paper by pressing the end of the sheets of paper discharged on paper tray in accordance with the sheet size (see Unexamined Publication No. JP-A-5-8581). However, this sheet post-processing device is not capable of preventing the bending of larger size paper discharged on top of smaller size paper as it simply intends to prevent damages of the sheets by pressing on the end of the sheets with a constant force regardless of the sheet size while straightening out the sheets.

Also, an image forming device is disclosed by inserting a separating sheet of paper in front of each file when a multiple files are being printed (see Unexamined Publication No. 2001-301245). However, this image forming device simply separates each file of printed matters irrespective of the size of paper used for printing and does not disclose a method of preventing the bending or creasing of paper.

OBJECTS AND SUMMARY

It is an object of the present invention to provide an image forming device, an image forming method, and a computer readable recording medium stored with a image forming program, which are all improved to solve the abovementioned problems.

It is another object of the present invention to provide an image forming device, an image forming method, and a computer readable recording medium stored with an image forming program capable of preventing paper of various sizes from causing bending or creasing when the paper of a plurality of sizes is discharged on the paper tray in large quantity.

According to an embodiment of the invention, there is provided an image forming device equipped with a paper tray for supporting discharged paper, comprising: a storage unit for storing a size of paper discharged on said paper tray; a detection unit for detecting whether-any paper is left on said paper tray; a comparison unit for comparing a size of paper ready to be discharged and the size of paper stored in said storage unit when paper is left on said paper tray; and a supply unit for supplying a supporting member having a bending strength larger than that of said paper on to the paper left on said paper tray in accordance with the comparison performed by said comparison unit.

According to this invention, larger size paper can be supported by a supporting member even in case when the larger size paper is discharged on top of smaller size paper after the smaller size paper has been discharged. As a result, bending or creasing of various sizes of paper due to gravity can be prevented when a large amount of paper of a plurality of sizes is discharged on the paper tray.

According to another embodiment of the invention, there is provided an image forming method used on an image forming device equipped with a paper tray for supporting discharged paper, comprising the steps of: 1) storing in a storage unit a size of paper discharged on said paper tray; 2) detecting whether any paper is left on said paper tray; 3) comparing a size of paper ready to be discharged and the size of paper stored in said storage unit when paper is left on said paper tray; and 4) supplying a supporting member having a bending strength larger than that of said paper on to the paper left on said paper tray in accordance with the comparison performed in said step 3).

According to a further embodiment of the invention, there is provided a computer readable recording medium stored with an image forming program for controlling an image forming device equipped with a paper tray for supporting discharged paper, said image forming program causing the image forming device to execute a process comprising the steps of: 1) storing in a storage unit a size of paper discharged on said paper tray; 2) detecting whether any paper is left on said paper tray; 3) comparing a size of paper ready to be discharged and the size of paper stored in said storage unit when paper is left on said paper tray; and 4) supplying a supporting member having a bending strength larger than that of said paper on to the paper left on said paper tray in accordance with the comparison performed in said step 3).

The objects, characteristics and properties of this invention other than those set forth above will become apparent from the description given herein below with reference to preferred embodiments illustrated in the accompanying drawings.

DETAILED DESCRIPTION OF PREFERED EMBODIMENTS

The embodiments of this invention will be described below with reference to the accompanying drawings.

Figure 1:
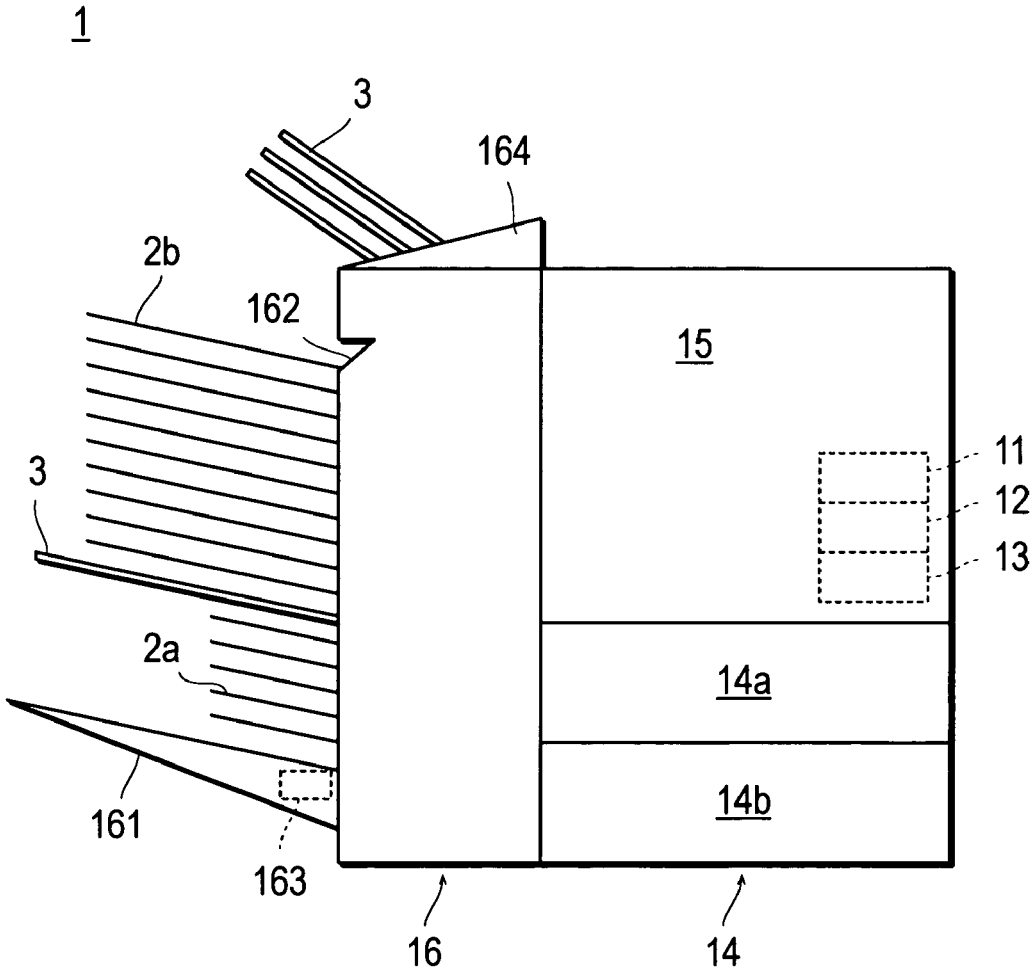
FIG. 1 is a schematic front view showing the constitution of a printer, which serves as an image forming device according to a first embodiment of the present invention.
Figure 2:
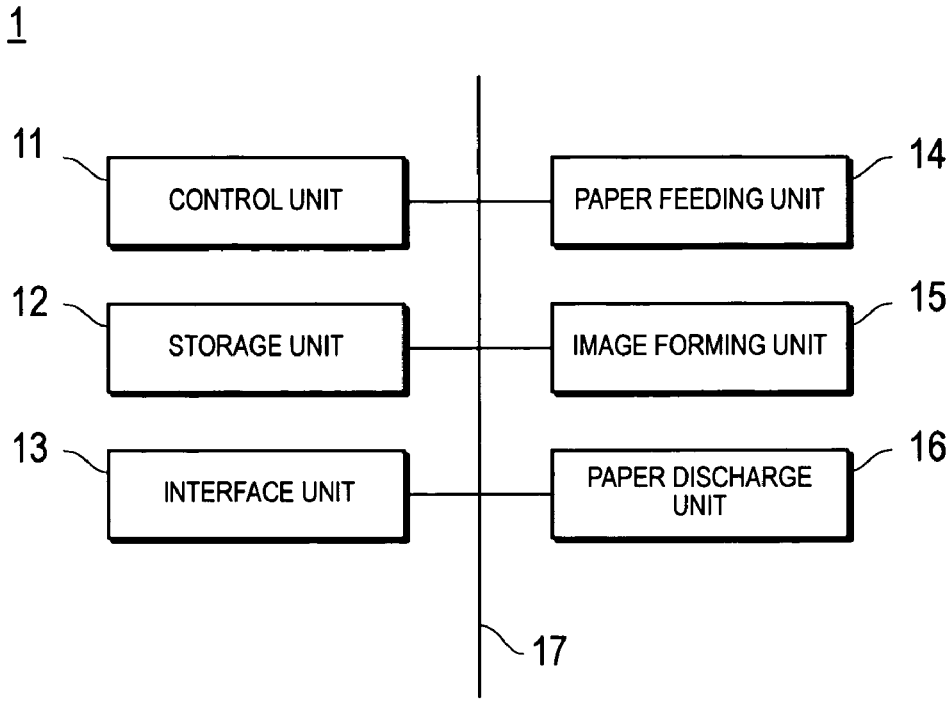
FIG. 2 is a block diagram showing the constitution of the printer shown in FIG. 1.

FIG. 1 is a schematic front view showing the constitution of a printer, which serves as an image forming device according to a first embodiment of the present invention, and FIG. 2 is a block diagram showing the constitution of the printer shown in FIG. 1.

The printer 1 is equipped with a control unit 11, a storage unit 12, an interface unit 13, a paper feeding unit 14, an image forming unit 15, and a paper discharge unit 16, all of which are interconnected via a bus 17 for exchanging signals.

The control unit 11 includes a CPU, and controls various parts indicated above and executes various arithmetic processes according to a program. The storage unit 12 consists of a ROM for storing various programs and data, a RAM for temporarily storing programs and data as a working area, a hard disk for storing various programs and data including an operating system, etc.

The interface unit 13 is an interface for communicating with external equipment, and network interfaces such as Ethernet®, Token Ring, and FDDI standards, serial interfaces such as USB and IEEE 1394, parallel interfaces such as SCSI and IEEE 1284, wireless communication interfaces such as Bluetooth®, IEEE 802.11, HomeRF®, and IrDA®, as well as telephone circuit interfaces for connection to telephone circuits can be used.

Paper feeding units 14*a* and 14*b* contain paper which is used as recording media in the printing process. The paper feeding unit 14 (collective name for 14*a* and 14*b*) feeds the contained paper to the image forming unit 15 one sheet at a time.

The image forming unit 15 prints various kinds of data on paper using a known imaging process such as the electronic photographing process including such processes as electrical charging, exposure, developing, transferring and fixing.

The paper discharge unit 16 discharges printed paper transported from the image forming unit 15. The paper discharge unit 16 is capable of applying finishing processes such as stapling process and punching process to the paper transported from the image forming unit 15.

The paper discharge unit 16 is equipped with a paper tray 161 for supporting discharged paper and a paper discharge port 162 through which it discharges the paper toward the paper tray 161. The paper tray 161 can be elevated up or down depending on the amount of paper loaded on said paper tray 161. In other words, the paper tray 161 is controlled to be located slightly below the paper discharge port 162 in the beginning and go down gradually as more paper is loaded. This makes it possible for the paper tray 161 to catch the discharged paper always at a constant height. Therefore, the discharged paper is stacked neatly on the paper tray 161.

In this embodiment, the paper discharge unit 16 is equipped with a paper detection unit 163 for detecting if there is any paper left on the paper tray 161, i.e., the presence of paper on the paper tray 161. The paper detection unit 163 includes an optical sensor to detect the paper on the tray 161 optically. The paper detection unit 163 is preferably provided on the paper tray 161 but can also be provided at other locations of the paper discharge unit 16. The paper detection unit 163 can have a weight sensor for detecting the weight of the paper on the paper tray 161. The paper detection unit 163 can be equipped with a paper tray position sensor for detecting the height position of the elevating paper tray 161.

The paper discharge unit 16 is also equipped with a supporting member supply unit 164 for supplying a supporting member 3 having a bending strength larger than that of paper 2*a* and 2*b* used for printing onto the paper tray 161. The supporting member 3 is typically made of paper board but is not limited to it and can be a plate-like member made from any kind of material such as plastic. The supporting member supply unit 164 is equipped with a tray that can hold a plurality of the supporting members 3 to be supplied. The supporting member 3 has a size equal to that of the paper to be used for printing or larger.

The printer 1 can include components other than those components mentioned above, or can lack some of the components mentioned above.

Next, the operation of the printer 1 according to the first embodiment will be described in the following.

Figure 3:
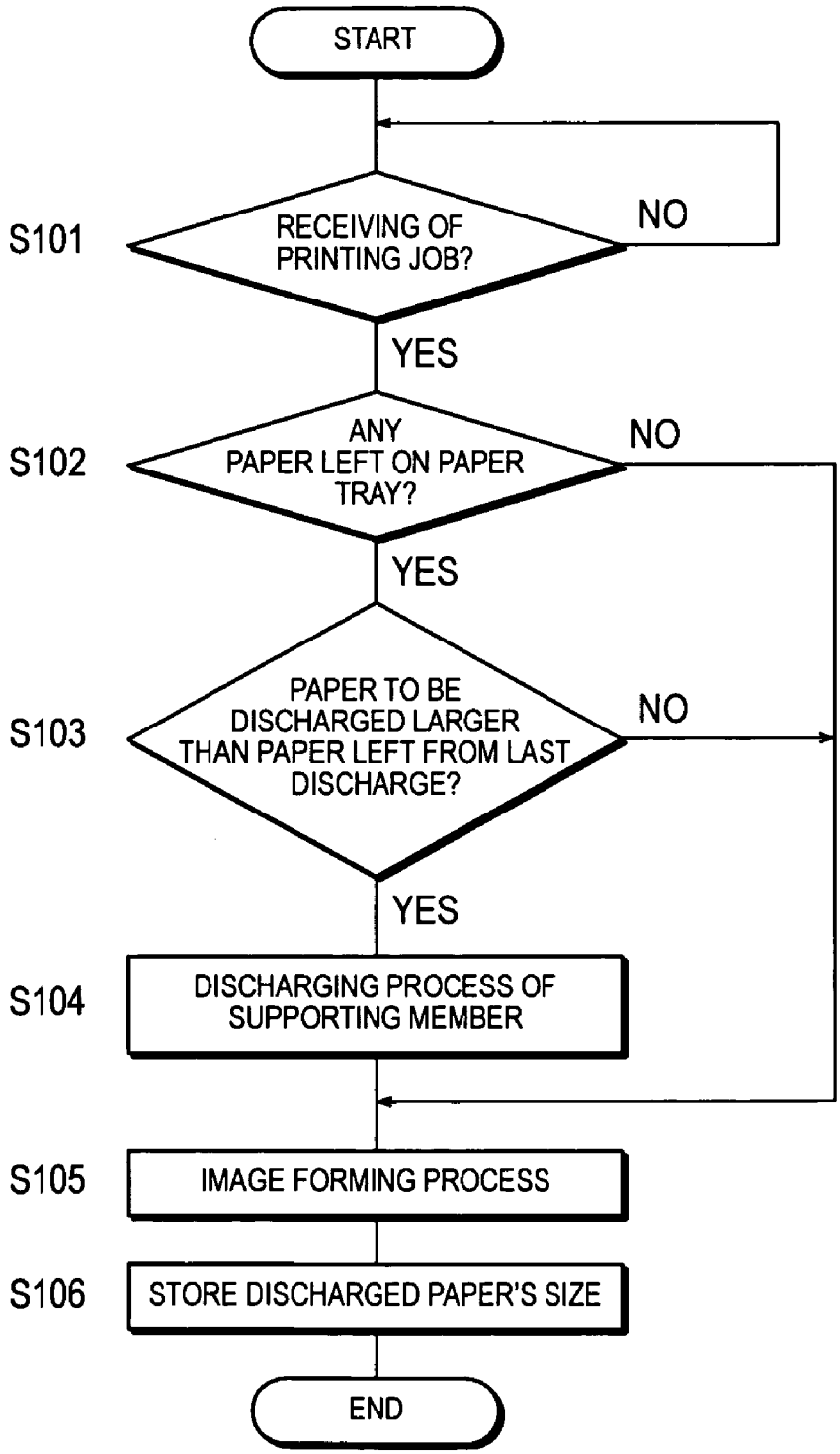
FIG. 3 is a flowchart showing the sequence of process on the printer according to the first embodiment of the present invention.

FIG. 3 is a flowchart showing the sequence of process on the printer 1 according to the first embodiment of the present invention. The algorithm shown in the flow chart of FIG. 3 is stored as a program in the storage unit 12 of the printer 1 and executed by the control unit 11.

First, referring to FIG. 3, the printer 1 waits until the printing job is received (S101: No).

When a printing job is received via the interface unit 13 (S101: Yes), a judgment will be made as to whether any paper is left on the paper tray 161 based on the detection signal of the paper detection unit 163 (S102).

If it is judged that no paper exists on the paper tray 161 (S102: No), the operation advances to the step S105.

In the step S105, the image forming process is performed. More specifically, the control unit 11 transmits the paper supply signal to the paper feeding unit 14 for supplying the paper to be used in printing to the image forming unit 15. When the paper is transported to the image forming unit 15 from the paper feeding unit 14, the control unit 11 transmits the image forming signal to the image forming unit 15 in order to print the specified image on the paper. When the paper printed with the specific image is transported from the image forming unit 15 to the paper discharge unit 16, the control unit 11 then transmits a paper discharge signal to the paper discharge unit 16 to discharge the printed paper via the discharge port 162 to the paper tray 161. The printed paper thus discharged is stacked on the paper tray 161.

In the step S106, the size of the printed paper thus discharged is stored in the storage unit 12. The size of the paper is recognized based on the information of the paper size typically contained in the printing job.

On the other hand, if it is judged that paper is left on the paper tray 161 in the step S102 (S102: Yes), a judgment is made as to whether the size of the paper ready to be discharged is larger or not than the size of the paper left on the paper tray 161 as a result of the last discharge (S103). The control unit 11 here recognizes the size of the paper that is to be discharge at this point based on, for example, the information of the paper size contained in the printing job and compares the recognized paper size with that of the size of the paper discharged last time stored in the storage unit 12 (refer to S106).

When the paper which is about to be discharge is equal in size or smaller than the paper left on the paper tray 161 as a result of the last discharge (S103: No), the operation advances to the step S105.

On the other hand, if the paper which is about to be discharged is larger in size than the paper left on the paper tray 161 as a result of the last discharge (S103: Yes), a discharging process of the supporting member 3 is executed (S104). However, the system can be so constituted that a discharging process of the supporting member 3 is executed only if the paper which is about to be discharged is larger by a certain ratio in size than the paper left on the paper tray 161 as a result of the last discharge.

More specifically, the supporting member 3 is supplied on the paper stacked on the paper tray 161. The control unit 11 transmits here a signal to the supporting member supplying unit 164 for supplying the supporting member 3 to the paper tray 161.

When the discharging process of the supporting member 3 is completed, the aforementioned image forming process is executed (S105), and the size of the printed paper discharged to the paper tray 161 is stored on the storage unit 12 (S106). When a paper size is already stored in the storage unit 12, it is updated to the sized of the paper discharged based on the printing job processed the last time. Thus, the size of the paper which is about to be discharged and the size of the paper discharged immediately before can be compared.

Thus, the printer 1 of the present embodiment compares the size of the paper ready to be discharged with the size of the paper left on the paper tray 161 if there is any paper left on the paper tray 161, and supplies on the paper left on the paper tray 161 a supporting member 3 having a larger bending strength than the paper depending on the result of the comparison.

Figure 4:
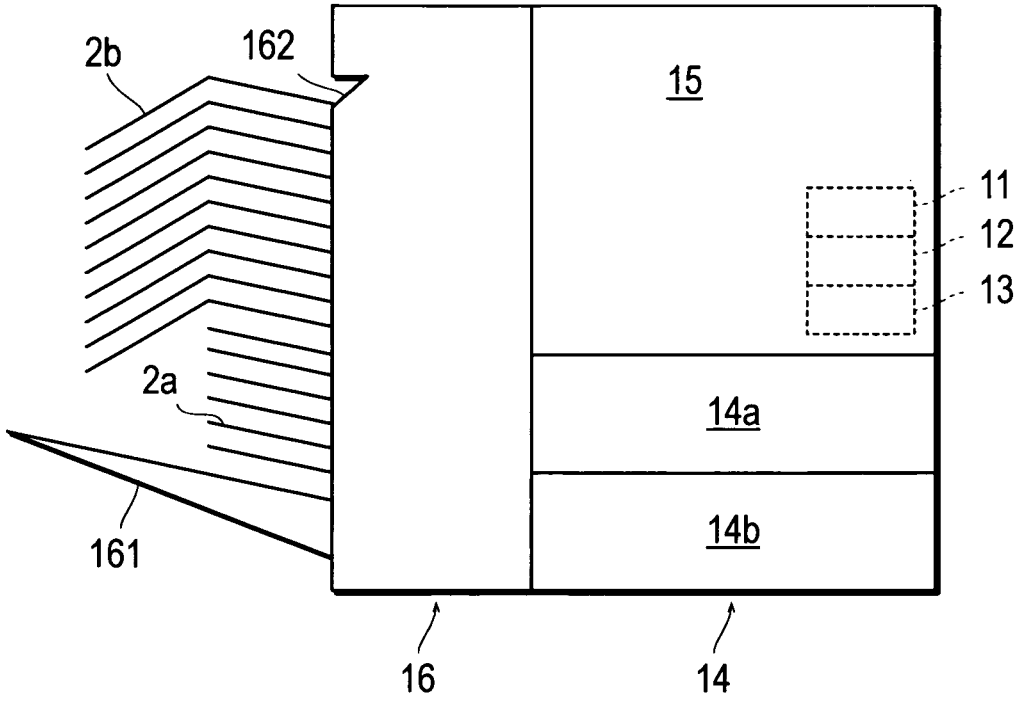
FIG. 4 is a diagram to show how large size paper causes bending or creasing due to its self weight.

Therefore, even when a paper 2*b* of a size larger than that of a smaller size paper 2*a* is discharged after the smaller size paper 2*a* is discharged on the paper tray 161, the larger size paper 2*b* can be supported by the supporting member 3 as shown in FIG. 1. As a result, bending or creasing of various sizes of paper due to gravity (refer to FIG. 4) can be prevented when a large amount of paper of a plurality of sizes, e.g., 2*a* and 2*b*, is discharged on the paper tray 161.

Next, the second embodiment of the invention will be described below. The second embodiment is different from the first embodiment in that the number of supporting members 3 to be supplied varies with the volume of paper that can be further loaded on the paper tray 161. The following description will concentrate mainly on those points that are different from the first embodiment.

Figure 5:
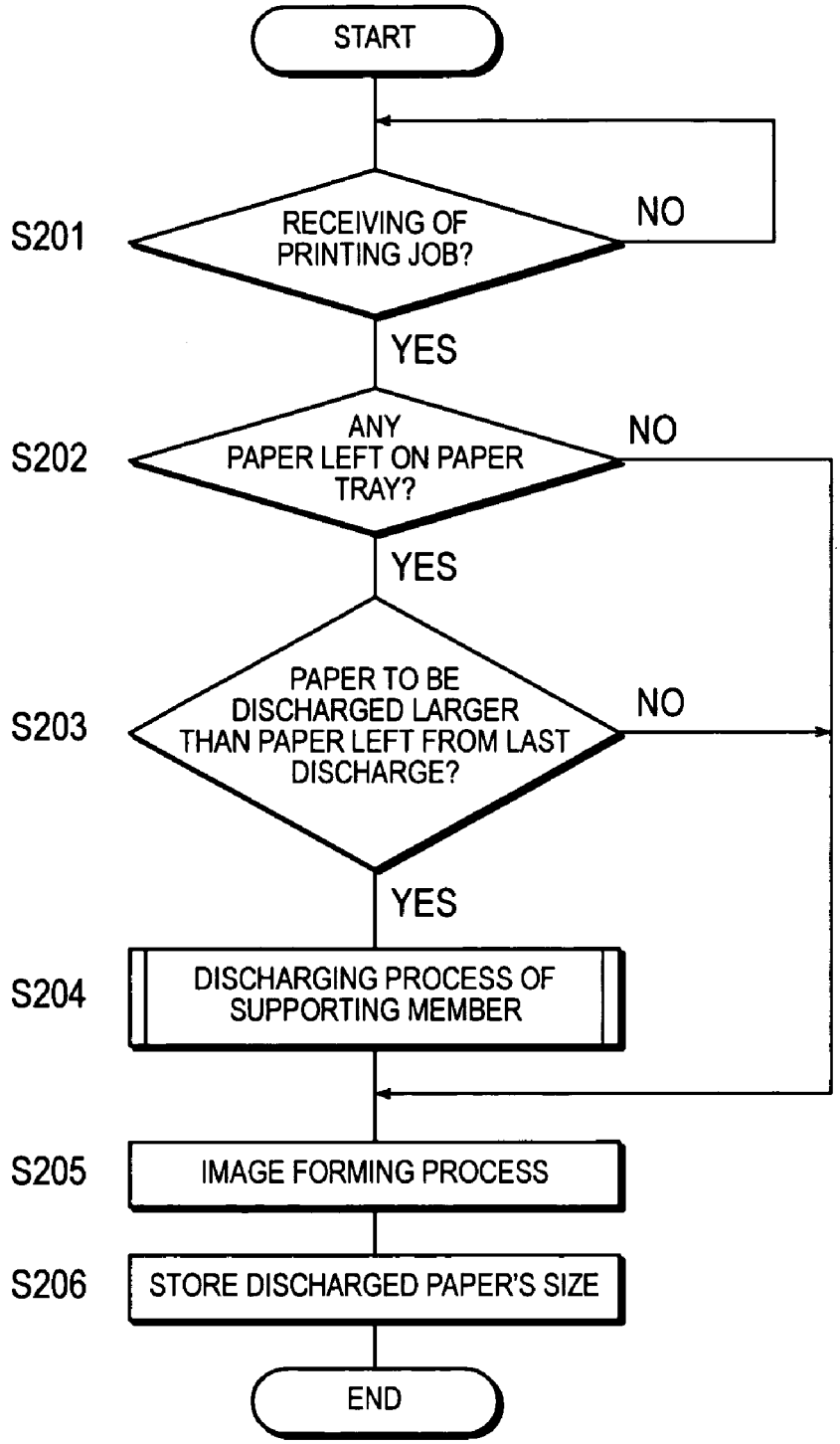
FIG. 5 is a flowchart showing the sequence of process on the printer according to a second embodiment of the present invention.
Figure 6:
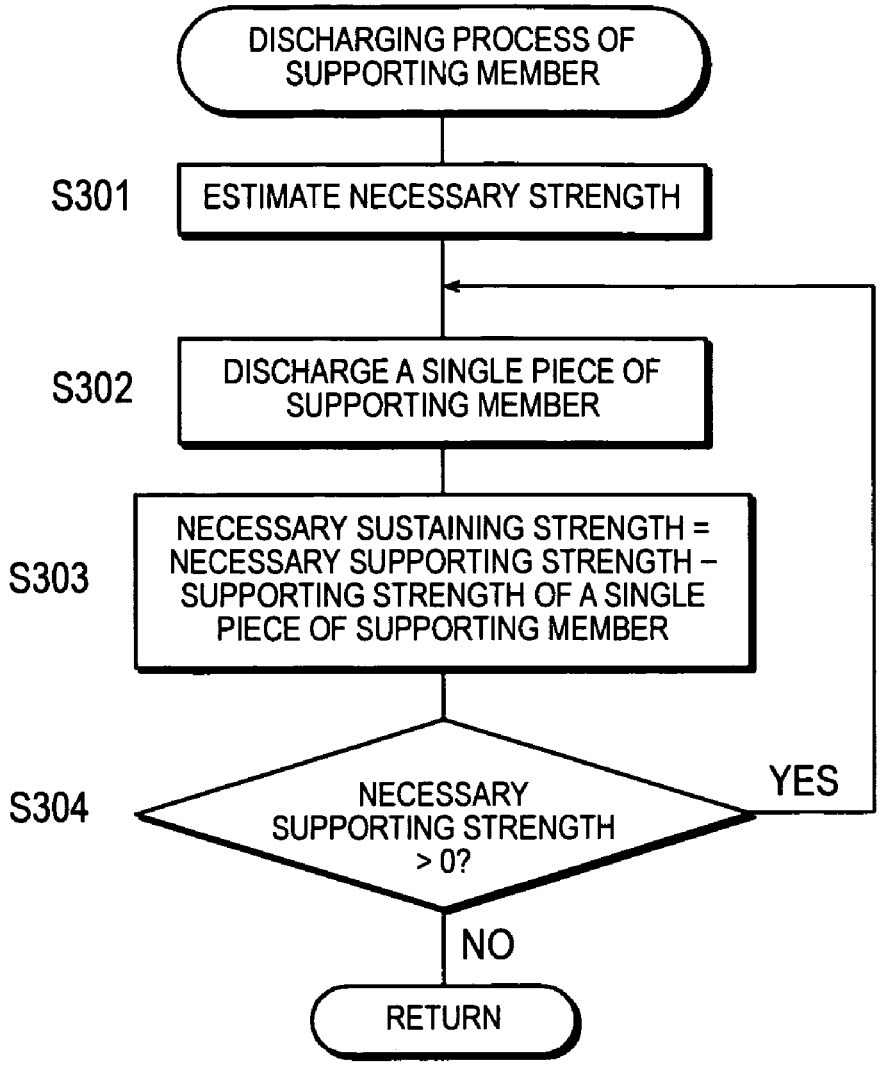
FIG. 6 is a flowchart showing the sequence of the discharging process of a supporting member.

FIG. 5 and FIG. 6 are flowcharts showing the sequence of process on the printer 1 according to a second embodiment of the present invention. The algorithm shown in the flow charts of FIG. 5 and FIG. 6 is stored as a program in the storage unit 12 of the printer 1 and executed by the control unit 11.

The steps S201 through S203, S205, and S206 shown in FIG. 5 are identical to the steps S101 through S103, S105, and S106 shown in FIG. 3, so that their descriptions are not repeated here.

The discharging process of the supporting member 3 in the step S204 will be described below with reference to FIG. 6.

A supporting strength necessary for the supporting member 3 is estimated (S301). Here, the control unit 11 detects the mass (g) of the paper left on the paper tray 161 based on the detection signal of the weight sensor detecting the weight of the paper on the paper tray 161 or the paper tray position sensor, and estimates the mass (g) of the paper that can be further loaded on said paper as a supporting strength that is required for the supporting member 3. The estimated supporting strength is stored into the storage unit 12.

Next, a piece of the supporting member 3 is discharged onto the paper left on the paper tray 161 (S302). The control unit 11 transmits here a signal to the supporting member supplying unit 164 for supplying a piece of the supporting member 3 to the paper tray 161.

Next, the control unit 11 stores in the storage unit 12*a* value obtained by subtracting the strength that a piece of the supporting member 3 can provide from the required supporting strength stored in the storage unit 12 as a new necessary supporting strength (S303). The strength that a piece of the supporting member 3 can provide is given as a mass (g) of paper that a piece of the supporting member 3 can support and is stored in the storage unit 12 in advance.

Then, a judgment is made in the step S304 as to whether the required supporting strength stored in the storage unit 12 is greater than 0 (zero) or not. If the required supporting strength stored in the storage unit 12 is greater than 0 (zero) (S304: Yes), the operation returns to the step S302 and another piece of the supporting member 3 is discharged (S302) and a necessary strength is updated (S303).

When the necessary supporting strength stored in the storage unit 12 becomes lower than 0 (zero) (S304: No), it is judged that a sufficient number of pieces of the supporting member 3 is discharged and the operation returns to the flowchart of FIG. 5.

Thus, the second embodiment allows the system to determine the number of pieces of the supporting member 3 required in response to the amount of paper that is loadable on the paper tray 161. Therefore, it becomes possible to use a necessary and sufficient number of supporting member 3 that withstands the weight of the paper to be discharged later. This makes it possible to prevent assuredly from the larger size paper 2*b* from causing bends and creases due to its self-weight.

Next, the third embodiment of the invention will be described below. The third embodiment is different from the second embodiment in that a portion of the multiple pieces of supporting member determined in accordance with the amount of loadable paper is discharged every time a certain number of sheets of paper is discharged on said sheets of paper. The following description will concentrate mainly on those points that are different from the second embodiment.

Figure 7:
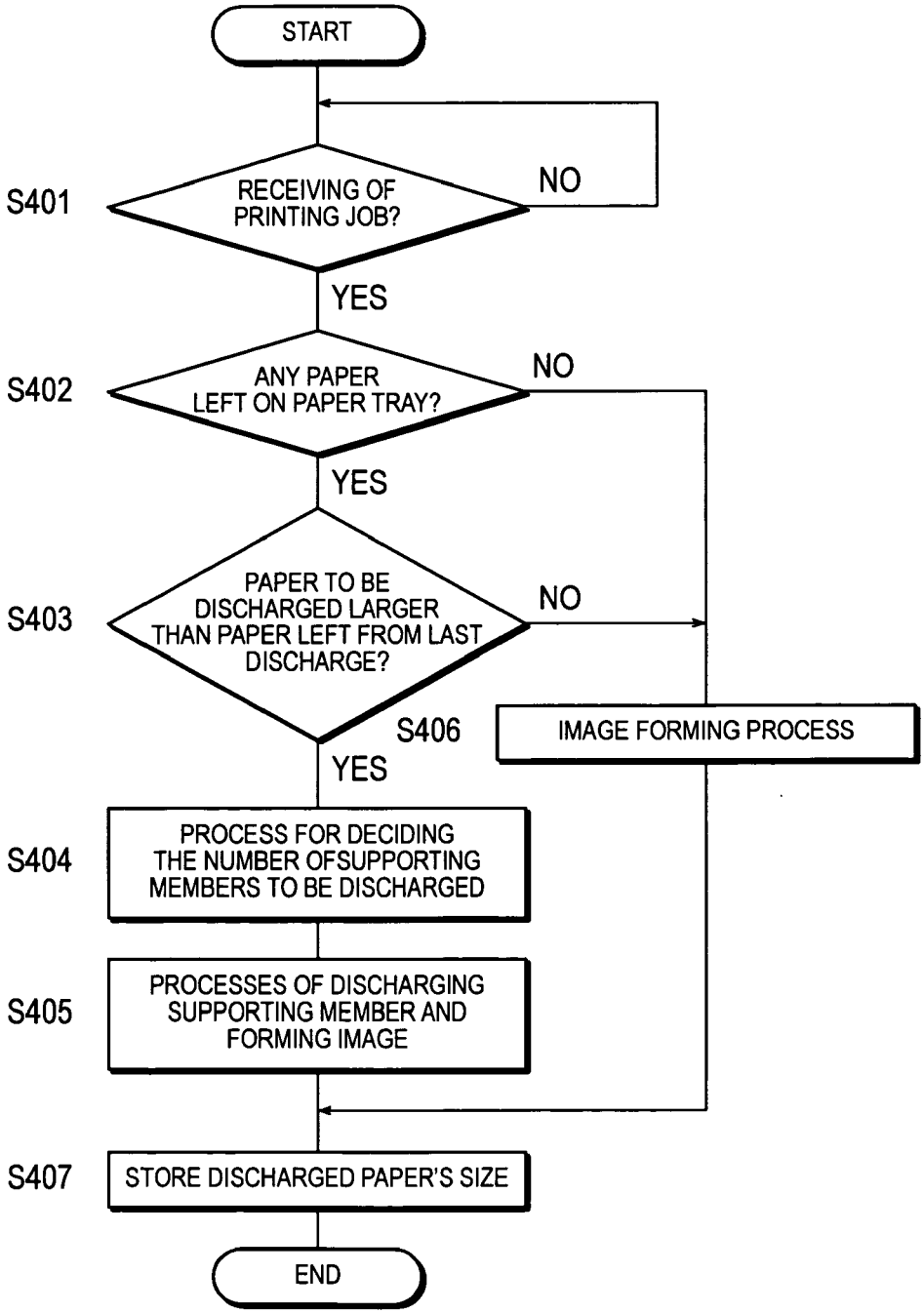
FIG. 7 is a flowchart showing the sequence of process on the printer according to a third embodiment of the present invention.

FIG. 7 is a flowchart showing the sequence of process on the printer 1 according to a third embodiment of the present invention. The algorithm shown in the flow chart of FIG. 7 is stored as a program in the storage unit 12 of the printer 1 and executed by the control unit 11.

The steps S401 through S403, S406, and S407 shown in FIG. 7 are identical to the steps S201 through S203, S205, and S206 shown in FIG. 5, so that their descriptions are not repeated here.

First, the process for deciding the number of the supporting member to be discharged in the step S404 will be described below with reference to FIG. 7. The number of pieces of the supporting member 3 is determined in a similar manner as in the second embodiment. In other words, the mass (g) of the paper that is loadable is estimated as the necessary strength required for the supporting member 3. Next, the number of pieces of the supporting member 3 is determined by rounding up a value obtained by dividing the estimated necessary supporting strength with the strength supportable with a single piece of the supporting member 3.

Next, the processes of discharging the supporting member and forming the image are performed (S405). More specifically, a portion of the calculated number of pieces of the supporting member 3 (e.g., a single piece of the supporting member 3) is supplied onto the particular sheets of paper each time a specified number of sheets of paper (e.g., 100 sheets) are discharged onto the paper tray 161. The process of forming the image is identical to that of the step S205 so that its description is not repeated.

However, it can be so constituted that a portion of the pieces of the supporting member 3 (e.g., a piece of the supporting member 3) is supplied after all the sheets of paper to be printed in the particular printing job are discharged if the number of pages included in the printing job being executed does not reach a specified number.

Thus, the third embodiment provides an effect similar to that of the second embodiment and also makes it possible to split the printed paper in accordance with a specified number or printing job.

It is obvious that this invention is not limited to the particular embodiments shown and described above but may be variously changed and modified without departing from the technical concept of this invention.

For example, although a printer is mentioned as the image forming device in the above embodiment, other image forming devices such as a copying machine and MFP (Multi-Function Peripheral) can be used as well as the image forming device of this invention.

The means and method of conducting various processes in the image forming device according to the present invention can be realized by means of a dedicated hardware circuit, or a programmed computer. Said program can be provided either by a computer readable recording medium such as a flexible disk and a CD-ROM, or by being supplied on-line via a network such as the Internet. In this case, the program recorded on the computer readable recording medium is normally transferred to and stored in a storage unit such as a hard disk. Said program can also be provided as independent application software or can be built into the software of the image forming device as a part of its function.

What is claimed is:

1. An image forming device equipped with a paper tray for supporting discharged paper, comprising:

a storage unit for storing a size of paper discharged on said paper tray;

a detection unit for detecting whether any paper is left on said paper tray;

a comparison unit for comparing a size of paper ready to be discharged and the size of paper stored in said storage unit when paper is left on said paper tray; and a supply unit for supplying a supporting member having a bending strength larger than that of said paper on to the paper left on said paper tray in accordance with the comparison performed by said comparison unit.

2. An image forming device as claimed in claim 1, wherein said supply unit supplies said supporting member when the size of paper ready to be supplied is greater than the size of paper stored in said storage unit.

3. An image forming device as claimed in claim 1, further comprising:

a decision making unit that decides a number of pieces of the supporting member to be supplied based on a quantity of paper loadable onto said paper tray.

4. An image forming device as claimed in claim 3, wherein said supply unit supplies a portion of the number of pieces of the supporting member determined by said decision making unit each time when a specified number of sheets of paper is discharged.

5. An image forming device as claimed in claim 4, wherein said supply unit supplies a portion of the multiple pieces of the supporting member after all the sheets of paper to be printed in accordance with said printing job are discharged when the number of pages included in a printing job being process has not reached the specified number.

6. An image forming device as claimed in claim 1, wherein the paper size stored in said storage unit is updated to the size of the paper discharged based on the printing job last processed.

7. An image forming device as claimed in claim 1, wherein said paper size is recognized based on the information included in the printing job.

8. An image forming device as claimed in claim 1, wherein the paper tray can be elevated up or down depending on the amount of paper loaded on said paper tray.

9. An image forming method used on an image forming device equipped with a paper tray for supporting discharged paper, comprising the steps of:

1) storing in a storage unit a size of paper discharged on said paper tray;

2) detecting whether any paper is left on said paper tray;

3) comparing a size of paper ready to be discharged and the size of paper stored in said storage unit when paper is left on said paper tray; and 4) supplying a supporting member having a bending strength larger than that of said paper on to the paper left on said paper tray in accordance with the comparison performed in said step 3).

10. An image forming method as claimed in claim 9, wherein in the step 4) said supporting member is supplied when the size of paper ready to be supplied is greater than the size of paper stored in said storage unit.

11. An image forming method as claimed in claim 9, further comprising the step of:

5) deciding a number of pieces of the supporting member to be supplied based on a quantity of paper loadable onto said paper tray.

12. An image forming method as claimed in claim 11, wherein in the step 4) a portion of the number of pieces of the supporting member determined by said decision making unit is supplied each time when a specified number of sheets of paper is discharged.

13. An image forming method as claimed in claim 12, wherein in the step 4) a portion of the multiple pieces of the supporting member is supplied after all the sheets of paper to be printed in accordance with said printing job are discharged when the number of pages included in a printing job being process has not reached the specified number.

14. An image forming method as claimed in claim 9, wherein the paper size stored in said storage unit is updated to the size of the paper discharged based on the printing job last processed.

15. An image forming method as claimed in claim 9, wherein said paper size is recognized based on the information included in the printing job.

16. An image forming method as claimed in claim 9, wherein the paper tray can be elevated up or down depending on the amount of paper loaded on said paper tray.

17. A computer readable recording medium stored with an image forming program for controlling an image forming device equipped with a paper tray for supporting discharged paper, said image forming program causing the image forming device to execute a process comprising the steps of:

1) storing in a storage unit a size of paper discharged on said paper tray;

2) detecting whether any paper is left on said paper tray;

3) comparing a size of paper ready to be discharged and the size of paper stored in said storage unit when paper is left on said paper tray; and 4) supplying a supporting member having a bending strength larger than that of said paper on to the paper left on said paper tray in accordance with the comparison performed in said step 3).

* * * * *